US005231238A

United States Patent [19]

Adams

[11] Patent Number: 5,231,238

[45] Date of Patent: Jul. 27, 1993

[54] INTEGRAL PICK DISPENSER FOR STRINGED INSTRUMENTS

[76] Inventor: Kim D. Adams, 50 Maple Ave., Bethel, Conn. 06801

[21] Appl. No.: 835,051

[22] Filed: Feb. 11, 1992

Related U.S. Application Data

[63] Continuation of Ser. No. 490,844, Mar. 9, 1990, abandoned.

[51] Int. Cl.[5] ..... G10D 3/00

[52] U.S. Cl. ..... 84/329

[58] Field of Search ..... 84/322, 329, 453

[56] References Cited

U.S. PATENT DOCUMENTS 4,135,431 1/1979 Ferguson ..... 84/329

OTHER PUBLICATIONS

P. 7 of brochure by Dunlop Manufacturing, Inc. 170 Industrial Way, Benicia, Calif. 94510 Date unknown.

*Primary Examiner*—Michael L. Gellner
*Assistant Examiner*—Cassandra C. Spyrou
*Attorney, Agent, or Firm*—John H. Crozier

[57] ABSTRACT

In a preferred embodiment, a pick dispenser for stringed instruments, which dispenser is integral with the body of the instrument. When used with a solid-body instrument, such as an electric guitar, the dispenser is disposed in a cavity formed in the body of the instrument. When used with a hollow-body instrument, such as an acoustic guitar, the dispenser is provided with its own housing which is disposed in an opening formed in a wall of the body of the instrument.

13 Claims, 1 Drawing Sheet

INTEGRAL PICK DISPENSER FOR STRINGED INSTRUMENTS

This is a continuation of co-pending application Ser. No. 07/490,884 filed on Mar. 9, 1990, now abandoned.

BACKGROUND OF THE INVENTION

1. Field of the Invention

The present invention generally relates to stringed instruments played with the use of plectrums, or "picks", such as guitars, and, more particularly, to a novel pick dispenser which may be built into, or retrofitted to, the bodies of such musical instruments so that replacement picks are readily accessible.

2. Background Art

Plucked stringed instruments are ancient and include lyres, guitars, and mandolins. When the strings of such instruments are of natural material, they are frequently plucked with the fingertips of the performer. However, when the instruments are wire-strung, and particularly with the modern electric guitars, the strings are usually plucked with a plectrum, or "pick". Such a pick, historically, was a lozenge-shaped spatula of a hard, flexible material, such as tortoise shell or metal, held in the performer's hand and struck across one or more strings. Today, however, such picks are usually made of somewhat flexible plastic materials.

A problem frequently experienced by performers of the latter type of such instruments, especially those instruments used for music that requires that the instruments be played rather vigorously, is that the picks break. Picks, being relatively small and smooth, are also often dropped. Since such breakage or droppage occurs during performance, it is essential that the performer be able to quickly replace the broken or dropped pick with a new one. This may necessitate the relatively time-consuming task of reaching into a pocket or instrument case to obtain a new pick of the desired degree of flexibility. During that time interval, of course, the instrument is not being played.

One solution to the problem of pick replacement has been the development of small, spring-loaded pick dispensers which the performer may keep in a pocket or other convenient location. These dispensers may be designed to hold a stack of picks of one degree of flexibility or they may be designed to have two or more stacks of picks of different degrees of flexibility. While these dispensers help somewhat with the problem of ready pick replacement, they suffer from the disadvantage that the dispenser must be found before a pick can be removed therefrom. If the dispenser contains picks of more than one degree of flexibility, it may, additionally, be necessary to determine visually which pick to select.

It would thus be desirable to have a pick dispenser which is always at hand when the instrument is being played and which is a part of instrument, itself.

Accordingly, it is principal object of the present invention to provide pick dispenser for stringed instruments which is integral with the body of the instrument.

Another object of the invention is to provide such a pick dispenser that may be built into the instrument or retrofitted to an existing instrument.

A further object of the invention is to provide such a pick dispenser that is economically and easily manufactured.

Other objects of the present invention, as well as particular features and advantages thereof, will be elucidated in, or be apparent from, the following description and the accompanying drawing figures.

SUMMARY OF THE INVENTION

The present invention achieves the above objects, among others, by providing, in a preferred embodiment, a pick dispenser for stringed instruments, which dispenser is integral with the body of the instrument. When used with a solid-body instrument, such as an electric guitar, the dispenser is disposed in a cavity formed in the body of the instrument. When used with a hollow-body instrument, such as an acoustic guitar, the dispenser is provided with its own housing which is disposed in an opening formed in a wall of the body of the instrument.

BRIEF DESCRIPTION OF THE DRAWING

The invention will be better understood if reference is made to the accompanying drawing figures, in which.

DETAILED DESCRIPTION OF THE PREFERRED EMBODIMENTS

Figure 1:
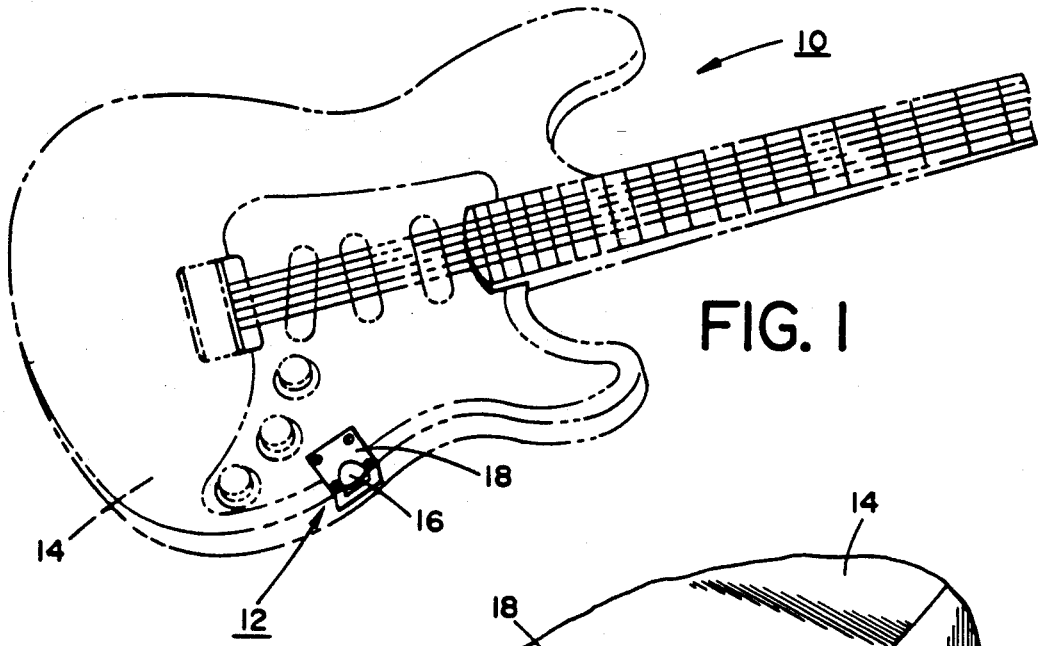
FIG. 1 is a perspective view of a stringed instrument with one embodiment of the present invention incorporated therein.
Figure 2:
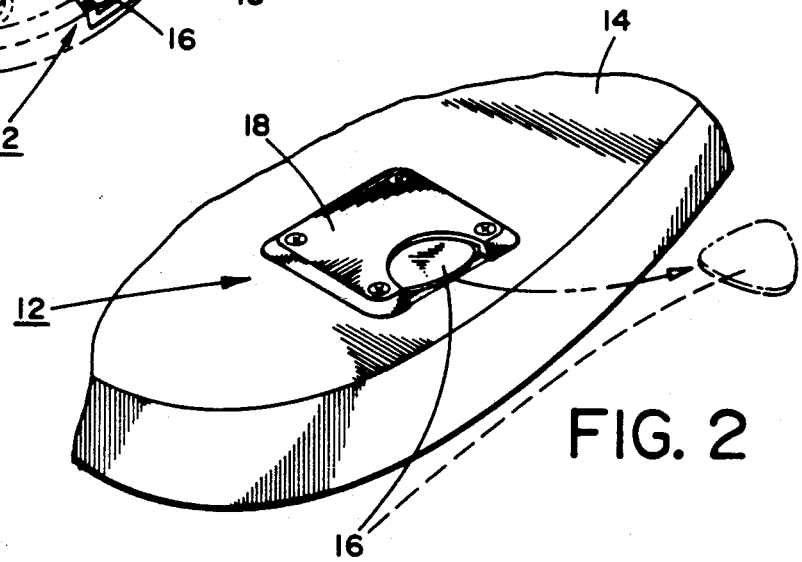
FIG. 2 is a fragmentary perspective view of a stringed instrument with another embodiment of the present invention incorporated therein.

Referring now to the Drawing, in which the same or similar elements are given consistent identifying numerals throughout the various figures thereof, FIG. 1 shows a stringed instrument, generally indicated by the reference numeral 10, with a pick dispenser of the present invention, generally indicated by the reference numeral 12, disposed at the edge of the body 14 of the instrument, while FIG. 2 shows the pick dispenser disposed in the body of the instrument away from the edge thereof. In each of FIGS. 1 and 2, a pick 16, removably held in place by a cover plate 18 which partially covers dispenser 12, is conveniently available for removal from the dispenser (dashed lines) by a performer (not shown).

Figure 3:
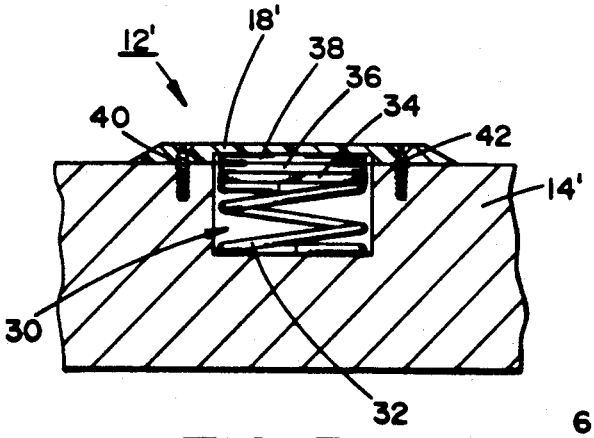
FIG. 3 is a fragmentary, cross-sectional view of a solid-body stringed instrument with one embodiment of the present invention incorporated therein.
Figure 4:
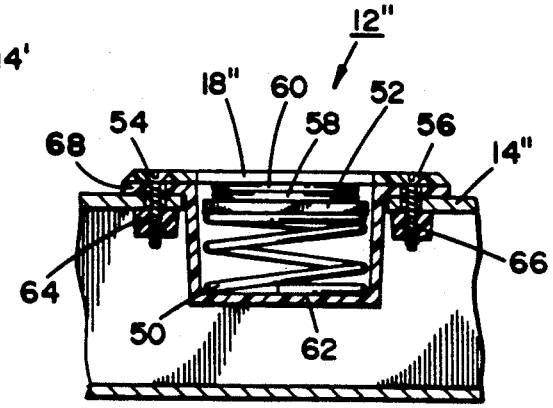
FIG. 4 is a fragmentary, cross-sectional view of a hollow-body stringed instrument with another embodiment of the present invention incorporated therein.

FIGS. 3 and 4 show the internal elements of two embodiments of the present invention.

With reference to FIG. 3, there is shown an embodiment of the present invention, generally indicated by the reference numeral 12', for insertion in a cavity 30 formed in a solid instrument body 14'. Dispenser 12' includes a spring 32 compressed between the bottom of cavity 30 and a spring plate 34. Captured between spring plate 34 and a cover plate 18' are picks 36 and 38. Cover plate 18' is attached to body 14' by means of screws 40 and 42. It will be understood that additional picks could be held in dispenser 12' by further compression of spring 32.

In use, a pick may be withdrawn from dispenser 12' by pressing against the upper surface of the pick and, by means of frictional resistance between a thumb or fingertip and the pick, sliding it out from under cover plate 18'. It will be understood that picks are loaded into dispenser 14' by reversing the foregoing procedure. If desired, additional dispensers similar to dispenser 12' may be disposed in body 14' so that picks of different degrees of flexibility may be readily at hand. Use of dispenser 14' ensures that a supply of picks will be immediately available for quick access and, once the performer has used the dispenser a few times, it will not even be necessary that there be visual contact when a new pick is withdrawn, resulting in very quick replacement of broken and dropped picks.

With reference to FIG. 4, there is shown an embodiment of the present invention, generally indicated by the reference numeral 12'', for insertion in a hollow instrument body 14'', the hollow body also being known as a "windchest". Dispenser 12'' is generally similar to dispenser 12' and includes a spring 50, a spring plate 52, and a cover plate 18'', the latter attached to body 14'' by means of screws 54 and 56, with the foregoing elements having the same functions as similar elements of dispenser 12'. Picks 58 and 60 are shown captured between spring 50 and cover plate 18''. Since body 14'' is hollow, a cavity is provided by a generally hollow housing 62, against the lower end of which housing the lower end of spring 50 bears and, since the walls of body 14'' are typically relatively thin, bosses 64 and 66 are provided to accept screws 54 and 56 which secure the housing in place by passing from cover plate 18'' through a flange 68 formed around the upper periphery of the housing.

Insertion of dispensers 12' and 12'' is relatively simple and can be done when the instruments are manufactured or the dispensers may be retrofitted to the instruments. In the case of dispenser 12', it is only necessary that cavity 30 of suitable dimensions be formed in body 12', spring 32 and spring plate 34 inserted therein, and cover plate 18' attached to the body. In the case of dispenser 12'', it is only necessary that an opening of suitable dimensions be formed in the wall of body 14'', bosses 64 and 66 glued, or otherwise attached, to the inside of the wall, spring 50 and spring plate 52 inserted in housing 62, the housing inserted in the opening, and cover plate 18'' screwed to the bosses, thus securing the housing in the opening.

The elements of dispensers 12' and 12'' may be constructed of any suitable materials known in the art.

It will thus be seen that the objects set forth above, among those made apparent from the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A pick dispenser disposed within a stringed instrument having a windchest, said windchest having a pick guard attached thereto and overlying a portion thereof, and said windchest having a peripheral edge, comprising:

(a) a cavity defined within said windchest of said stringed instrument, said cavity having a bottom and an open top, and said cavity being spaced apart from said pick guard and unattached thereto;

(b) pick moving means disposed in said cavity to urge picks to said top of said cavity;

(c) biasing means disposed in said cavity to urge said pick moving means toward said top of said cavity; and (d) cover means fixedly attached with respect to said cavity, unattached to said pick guard, and partially covering said cavity to removably retain at least one pick therein.

2. A pick dispenser, as defined in claim 1, wherein said pick moving means comprises a plate disposed for axial up-and-down movement within said cavity.

3. A pick dispenser, as defined in claim 1, wherein said biasing means comprises a spring compressed between said pick moving means and said bottom of said cavity.

4. A pick dispenser, as defined in claim 1, wherein said pick dispenser is disposed at said edge of said windchest.

5. A pick dispenser, as defined in claim 1, wherein said pick dispenser is disposed in said windchest inwardly from said peripheral edge thereof.

6. A pick dispenser, as defined in claim 1, wherein said cavity is provided by a generally hollow, open-top housing disposed in said windchest through an opening in said windchest.

7. A pick dispenser, as defined in claim 6, wherein said housing is secured to said windchest by means of fasteners extending from said cover means into said windchest through an outwardly facing flange formed around said open top.

8. A pick dispenser, as defined in claim 7, further comprising bosses attached to an inside surface of said hollow windchest to which said fasteners are attached.

9. A pick dispenser disposed within a stringed instrument having a solid body, said solid body having a pick guard attached thereto and overlying a portion thereof, and said solid body having a peripheral edge, comprising:

(a) a cavity defined within said body of said stringed instrument, said cavity having a bottom and an open top, said cavity comprising a hollowed out portion of said solid body, said hollowed out portion being spaced apart from said pick guard and unattached thereto;

(b) pick moving means disposed in said cavity to urge picks to said top of said cavity;

(c) biasing means disposed in said cavity to urge said pick moving means toward said top of said cavity; and (d) cover means fixedly attached with respect to said cavity, unattached to said pick guard, and partially covering said cavity to removably retain at least one pick therein.

10. A pick dispenser, as defined in claim 9, wherein said pick moving means comprises a plate disposed for axial up-and-down movement within said cavity.

11. A pick dispenser, as defined in claim 9, wherein said biasing means comprises a spring compressed between said pick moving means and said bottom of said cavity.

12. A pick dispenser, as defined in claim 9, wherein said pick dispenser is disposed at said edge of said solid body.

13. A pick dispenser, as defined in claim 9, wherein said pick dispenser is disposed in said solid body inwardly from said peripheral edge thereof.

* * * * *